United States Patent [19]

Niskanen et al.

[11] Patent Number: 4,936,207

[45] Date of Patent: Jun. 26, 1990

[54] SYSTEM OF ROLLS IN A SUPERCALENDER

[75] Inventors: Juhani Niskanen, Oulunsalo; Ari Lassila, Espoo; Harri Kuosa, Järvenpää; Pentti Hyytinen, Jävenpää; Hannu Mäkiä, Järvenpää, all of Finland

[73] Assignee: Valmet Paper Machinery Inc., Helsinki, Finland

[21] Appl. No.: 282,470

[22] Filed: Dec. 9, 1988

[30] Foreign Application Priority Data

Dec. 11, 1987 [FI] Finland ..... 875443

[51] Int. Cl.[5] ..... B30B 15/16; B30B 3/04

[52] U.S. Cl. ..... 100/47; 29/116.2; 72/245; 72/241.6; 100/50; 100/162 B; 100/170

[58] Field of Search ..... 100/47, 48, 50, 162 R, 100/162 B, 163 R, 163 A, 168, 169, 170; 29/116.2, 113.2; 72/245, 243

[56] References Cited

U.S. PATENT DOCUMENTS

| | | | |
|---|---|---|---|
| 4,212,504 | 7/1980 | Krylov et al. | 100/170 X |
| 4,464,921 | 8/1984 | Surat | 100/162 B X |
| 4,472,958 | 9/1984 | Biondetti | 29/116.2 X |
| 4,509,237 | 4/1985 | Volz et al. | 100/162 B X |
| 4,597,275 | 7/1986 | Schneid et al. | 72/243 X |
| 4,644,860 | 2/1987 | Brendel | 100/47 X |

*Primary Examiner*—Harvey C. Hornsby
*Assistant Examiner*—Stephen F. Gerrity
*Attorney, Agent, or Firm*—Dellett, Smith-Hill and Bedell

[57] ABSTRACT

A supercalender comprises a stationary variable-crown upper roll (1), a floating variable-crown lower roll (2), several intermediate rolls (3,4) between the upper roll (1) and the lower roll (2), and a hydraulic control system. The upper roll (1) has a roll mantle (12) that is supported on the roll shaft (11) by hydrostatic loading elements (13) acting in the direction of compression and by end bearings at the ends of the roll mantle, which bearings prevent displacement of the mantle (12) ends in the radial direction relative to the shaft (11) of the upper roll. The lower roll (2) has a roll mantle (22) that is supported on the roll shaft (21) adjustably in the direction of compression by means of hydrostatic loading elements (23). Position detectors (23,31) are provided at the ends of the shaft of at least one roll. The control system is arranged to regulate the positions of the rolls (1 to 4) in the system of rolls and to balance the forces effective in the supercalender in response to measurement signals received from the position detectors (27,31) and from the hydrostatic loading elements (23) of at least the lower roll.

6 Claims, 1 Drawing Sheet

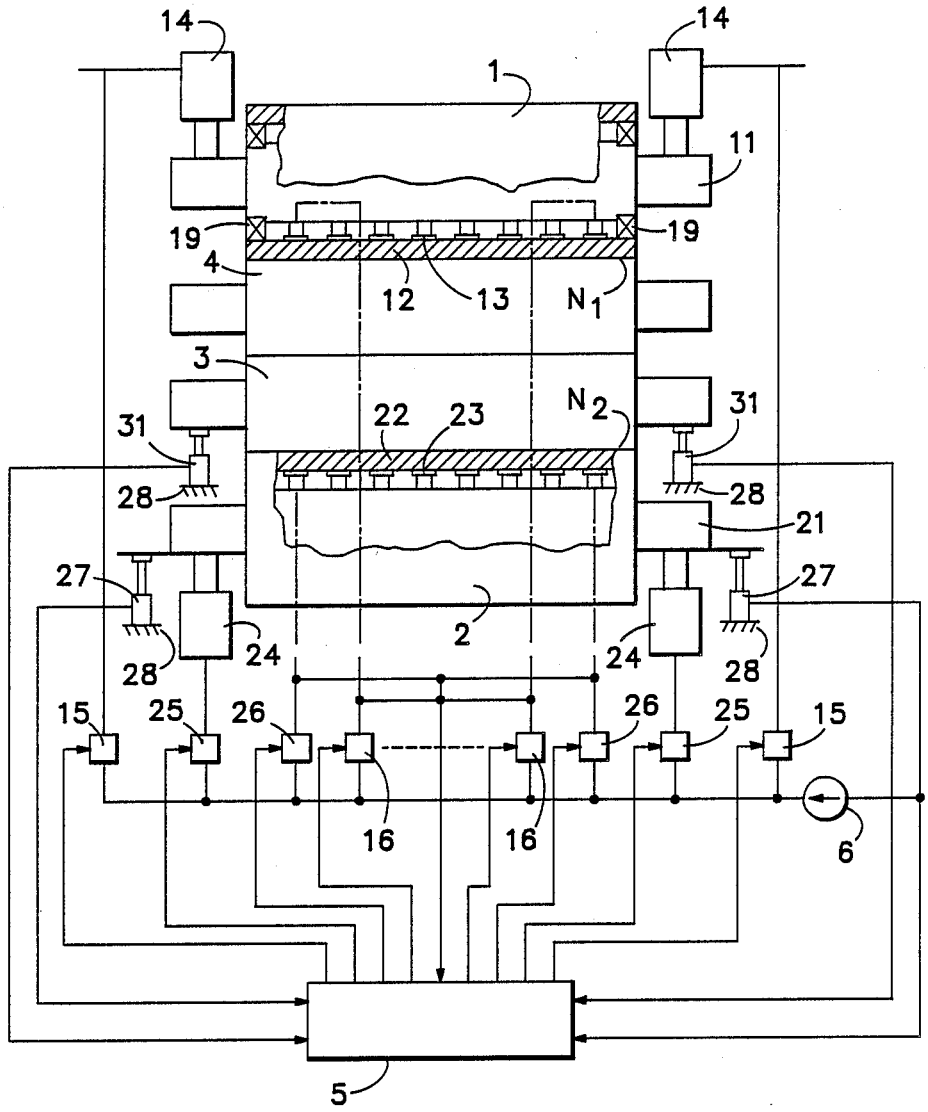
14
14
1
11
19
19
4
12
13
N1
3
N2
22
23
31
31
28
28
21
27
27
2
24
24
28
28
15
25
26
26
25
15
16
16
6
5

SYSTEM OF ROLLS IN A SUPERCALENDER

BACKGROUND OF THE INVENTION

The invention concern a system of rolls in a supercalender, comprising a variable-crown upper roll adjustable in zones, a variable-crown lower roll adjustable in zones, several intermediate rolls placed between the upper roll and the lower roll, as well as a hydraulic control system for the system of rolls.

During operation, the system of rolls in a supercalender is deflected, which results mainly from the journalling of the intermediate rolls in the system of rolls. This is why, at present, in supercalenders, variable-crown rolls, in particular rolls adjustable in zones, are used commonly as the upper and lower rolls. In principle, the variable-crown rolls and the rolls adjustable in zones may be either stationary, i.e. rolls in which the roll mantle is mounted at its ends relative the roll shaft by means of bearings so that the positions of the ends of the mantle cannot be changed relative the shaft, but in the area between the ends, the roll mantle can be deflected relative the roll shaft, or then, the rolls may be floating, i.e. rolls in which the roll mantle can also move at its ends relative the roll shaft in the direction of compression.

In a supercalender, a solution is known in prior art wherein a stationary variable-crown roll is used as the upper roll and as the lower roll in the system of rolls. In such a system of rolls, however, a considerable drawback consists of vibrations of the system of rolls, which are seen as inferior paper quality. The properties of attenuation of vibrations of a system of rolls are quite poor if both the upper roll and the lower roll are stationary variable-crown rolls.

Moreover, in prior art, solutions are known in which both the upper roll and the lower roll are floating variable-crown rolls, or in which the upper roll is floating and the lower roll is stationary. A floating upper roll, however, involves the considerable drawback that, when the roll shaft is loaded by means of external loading means, the upper roll cannot be made straight, because at the ends of the upper roll there are no bearing loads. In such a case, the distribution of the linear load at the upper roll cannot be made straight, and the profile of the linear load cannot even be made sufficiently accurate. Moreover, some paper qualities require relatively low levels of linear load, in which case the mantle of a floating upper roll cannot be placed in the correct position within the zones, but often the nip between the upper roll and the topmost intermediate roll may even remain open in the lateral areas. In connection with a floating upper roll, attempts have been made to correct the deflection by means of counter-zones provided in the area of the ends of the roll mantle, the direction of effect of said counter-zones being opposite to the direction of compression. However, the deflection cannot be corrected by means of the counter-zones either, because the roll mantle is very stiff.

A floating upper roll further involves the drawback that the upper roll must be positioned from time to time, e.g., owing to leakages in the hydraulic pressure cylinders acting as external loading means. Moreover, positioning must, of course, be carried out always when the size of the intermediate rolls is to be changed. Moreover, the requirements of accuracy of the positioning are very high, and since the positioning is carried out by means of hydraulic cylinders, these form a critical point in view of the hydraulic system of the set of rolls, because the pressures effective in the hydraulic cylinders are very high.

SUMMARY OF THE INVENTION

The object of the present invention is to provide an improvement over the prior-art solutions and, moreover, to avoid the drawbacks of said prior-art solutions. In view of achieving this, the invention is characterized in that the upper roll is a stationary variable-crown roll, whose roll mantle is supported on the roll shaft by means of hydrostatic loading elements acting in the direction of compression and by means of end bearings placed at the ends of the roll mantle, said bearings preventing displacement of the mantle ends in the radial direction relative the shaft of the upper roll, that the lower roll is a floating variable-crown roll, whose roll mantle is supported on the roll shaft adjustably in the direction of compression by means of hydrostatic loading elements, and that the system of rolls is provided with position detectors provided at the ends of the shaft of at least one roll, whereat the control system of the system of rolls is arranged, on the basis of measurement impulses received by it from the position detectors and from the hydrostatic loading elements of at least the lower roll, to regulate the positions of the rolls in the system of rolls and to balance the forces effective in the system of rolls based on the measurement of position.

As compared with the prior-art solutions, by means of the invention a number of advantages are obtained, whereof, e.g., the following should be mentioned. As compared with the case in which both the upper roll and the lower roll are stationary variable-crown rolls, substantially better properties of attenuation of vibration are achieved by means of the invention, because in the solution in accordance with the invention, the pistons in the zones of the floating lower roll act as elements that attenuate vibration. Moreover, the vibrating mass in the lower roll is smaller than in the case of a stationary lower roll.

On the other hand, compared with a floating upper roll, the following advantages are obtained by means of the invention. The diameter of a stationary roll becomes smaller than that of a floating roll, with the consequence that the stationary upper roll can be deflected into the correct position more readily. In such a case, the distribution of the linear load in the uppermost nip becomes better. The end bearings of the stationary roll form "one more zone" at the ends of the roll, whereby, when the roll shaft is loaded by means of external loading means, the roll can be deflected down at the ends and up at the middle more readily. The level of the linear load in the system of rolls is regulated by means of the external loading means; only correction of the level of linear load is carried out by means of the zones in the variable-crown roll. Moreover, by means of the external loading means, it is possible to reduce the weight of the roll to a level lower than its own weight, which gives a significant advantage in the case of certain paper qualities, for certain paper qualities require very low levels of linear load. By means of the equipment in accordance with the invention, good properties of profilation are obtained with low linear loads. Since, in the invention, a stationary variable-crown upper roll is used, the shaft of the upper roll does not have to be positioned equally accurately as in the case of a floating upper roll.

BRIEF DESCRIPTION OF THE INVENTION

The other advantages and characteristic features of the invention come out from the following detailed description of the invention, wherein the invention is described with reference to the FIGURE in the accompanying drawing. The FIGURE in the drawing is a schematical illustration of a system of rolls in accordance with the invention partly in section and, moreover, the drawing is a schematical illustration of the control system of the system of rolls.

DETAILED DESCRIPTION

In the FIGURE in the drawing, the upper roll in the system of rolls of a supercalender is denoted with the reference numeral 1. The upper roll 1 is a stationary variable-crown roll, which comprises a roll shaft 11 and a roll mantle 12, the mantle being supported on the shaft 11 by means of end bearings 19 as well as by means of hydrostatic loading elements 13, which have been divided into zones in the direction of width of the roll 1.

The shaft 11 of the upper roll is supported on the frame of the supercalender by means of external loading means 14, i.e. upper cylinders, which are used for regulating the level of the linear load in the system of rolls. The upper cylinders 14 are dual-action cylinders, so that by their means it is possible on the one hand to increase the level of linear load in the system of rolls in the desired way, and, on the other hand, to reduce the load caused by the upper roll 1 to a level lower than the roll's own weight. As the upper cylinders 14, it is advantageously possible to use differential cylinders, in which case a leakage in the cylinders has no essential effect on the position of the roll shaft 11 or on the level of linear load in the set of rolls.

The lower roll in the system of rolls is denoted with the reference numeral 2, and said lower roll is a floating variable-crown roll, which comprises a roll shaft 21 as well as a roll mantle 22 that is rotably supported on the roll shaft 21 exclusively by the intermediate of hydrostatic loading elements 23. Thus, the mantle 22 of the lower roll is not supported on the shaft 21 by means of stationary end bearings. Moreover, in the embodiment of the FIGURE, the lower roll 2 is provided with external loading means 24, i.e. lower cylinders, by means of which the position of the lower roll 2 can be altered. Between the upper roll 1 and the lower roll 2, in the conventional way, a number of intermediate rolls are provided, of which said intermediate rolls the lowermost and the uppermost intermediate rolls 3 and 4 are shown in the FIGURE in the drawing. Further, in the FIGURE, the upper nip, i.e. the nip between the upper roll 1 and the uppermost intermediate roll 4, is denoted with the reference symbol $N_1$ and, correspondingly, the lower nip, i.e. the nip between the lower roll 2 and the lowermost intermediate roll 3, is denoted with the reference symbol $N_2$.

The hydraulic system of the system of rolls of a supercalender in accordance with the invention is provided with a hydraulic pump 6, which supplies the pressure medium, e.g. hydraulic fluid, to the upper cylinders 14, to the lower cylinders 24, and to the hydrostatic loading elements 13 and 23 of the upper and lower roll. The pressure medium is supplied to the loading means 14 and 24 of the upper and lower roll through the regulating valves 15 and 25 and, correspondingly, the pressure medium is passed to the hydrostatic loading elements 13 and 23 of the upper and lower roll through separate regulating valves 16 and 26. As was already stated above, both in the upper roll 1 and in the lower roll 2, the hydrostatic loading elements 13 and 23, respectively, have been divided into zones in the direction of width of the rolls, whereby there is a regulating valve 16 and 26, respectively, of its own for each zone in the hydraulic system. At both ends of the shaft 21 of the lower roll, position detectors 27 are installed, which measure the position of the ends of the lower roll relative to the supercalender frame 28 and also measure the straightness of the lower roll 2. Moreover, at each end of the lowermost intermediate roll 3, corresponding position detectors 31 are provided, which measure the position of the ends of the lowermost intermediate roll relative to the supercalender frame 28 and also measure the straightness of said intermediate roll 3. The position detectors 31 may be provided at the ends of any of the intermediate rolls 3,4, but the most advantageous effect is obtained by placing the position detectors exactly at the ends of the lowermost intermediate roll 3.

The system of rolls of a supercalender in accordance with the invention is further provided with a control computer 5 that controls the hydraulic system of the set of rolls. The control computer 5 regulates the regulation valves 15 and 25 for the external loading means of the upper and lower roll and the regulation valves 16 and 26 for the hydrostatic loading elements in the upper and lower roll in accordance with the starting data given and with the control impulses received. The necessary regulation control impulses are received by the control computer 5, on one hand, from the position detectors 27 and 31 of the lower roll 2 and the intermediate roll 3, the control computer 5 constantly adjusting the position of the lower roll 2 and the straightness of the system of rolls correctly in accordance with the impulses given by said position detectors 27 and 31. On the other hand, the control computer 5 receives, control signals representative of the zone pressures in the hydraulic loading elements 13 and 23 of the upper roll and of the lower roll 2. From the zone pressures of the loading elements 23 of the lower roll 2, the control computer calculates the weight of the system of rolls, and from the weight of the system of rolls it further calculates the loading of the system of rolls. Thus, in accordance with the control signals received from the hydrostatic loading elements 13 and 23, the control computer 5, on one hand, adjusts the upper cylinders 14 so as to provide the correct level of linear load. On the other hand, the control computer 5 regulates the regulation valves 16 and 26 of the hydrostatic loading elements 13 and 23 of the upper and lower roll so as to adjust the linear load to the correct values across the width of the system of rolls. Thus, the forces effective in the system of rolls can be balanced on the basis of measurement of the position.

The invention is not confined to the embodiment shown in the accompanying schematical drawing alone, but the various embodiments of the invention may show variation within the scope of the inventive idea defined in the accompanying claims.

What is claimed is:

1. A supercalender comprising:

an upper roll, a lower roll, and at least one intermediate roll between the upper roll and the lower roll and having a roll shaft, the upper roll being a stationary variable-crown roll having a roll shaft, a roll mantle having two opposite ends, bearings supporting the roll mantle at its opposite ends relative to the roll shaft and preventing displacement of the mantle ends in the radial direction relative to the roll shaft, and multiple independently actuable hydrostatic loading elements intermediate the ends of the roll mantle and acting in a direction towards the lower roll, the lower roll being a floating variable-crown roll having a roll shaft, a roll mantle, and multiple independently actuable hydrostatic loading elements supporting the roll mantle on the roll shaft and acting in a direction towards the upper roll and said hydrostatic loading elements of said lower roll generating measurement signals corresponding to the loading on said rolls, and the supercalender further comprising:

position detectors at the ends of the roll shaft of at least one roll generating measurement signals corresponding to a position of said roll shaft of said one roll, and control means for controlling a supply of hydraulic fluid to the hydrostatic loading elements in response to measurement signals received from the position detectors and from the hydrostatic loading elements of at least the lower roll.

2. A supercalender according to claim 1, wherein the position detectors are mounted on the shaft of the lower roll to measure the position of the shaft of the lower roll.

3. A supercalender according to claim 1, wherein the position detectors are mounted at the ends of said one intermediate roll to measure the position of the shaft of said one intermediate roll.

4. A supercalender according to claim 3, wherein there are a plurality of intermediate rolls each with a roll shaft and the position detectors are mounted at the ends of the lowermost intermediate roll to measure the position of the shaft of said lowermost intermediate roll.

5. A supercalender according to claim 1, further comprising means for supplying fluid under pressure to the hydrostatic loading elements of the lower roll, and wherein the control means are responsive to the pressure of the fluid for determining the loading of the rolls.

6. A supercalender according to claim 1, further comprising hydrostatic loading means effective on the ends of the roll shaft of at least the upper roll for adjusting the linear load exerted by the rolls, and wherein the control means further control a supply of hydraulic fluid to said hydrostatic loading means in response to the pressure of the hydrostatic loading elements of the lower roll.

* * * * *